US008289224B2

(12) United States Patent
Halkiopoulos

(10) Patent No.: US 8,289,224 B2
(45) Date of Patent: Oct. 16, 2012

(54) SMART POLE

(75) Inventor: Evangelos Halkiopoulos, Peania (GR)

(73) Assignee: Powerwave Technologies, Inc., Santa Ana, CA (US)

( * ) Notice: Subject to any disclaimer, the term of this patent is extended or adjusted under 35 U.S.C. 154(b) by 688 days.

(21) Appl. No.: 12/085,334

(22) PCT Filed: Nov. 16, 2006

(86) PCT No.: PCT/IB2006/003235

§ 371 (c)(1),
(2), (4) Date: Aug. 24, 2009

(87) PCT Pub. No.: WO2007/060513

PCT Pub. Date: May 31, 2007

(65) Prior Publication Data

US 2010/0033399 A1 Feb. 11, 2010

(30) Foreign Application Priority Data

Nov. 22, 2005 (GR) ..... 050100576

(51) Int. Cl.
*H01Q 1/12* (2006.01)
*H01Q 1/42* (2006.01)

(52) U.S. Cl. ..... 343/890; 343/872; 343/874; 343/896; 343/900

(58) Field of Classification Search ..... None
See application file for complete search history.

(56) References Cited

U.S. PATENT DOCUMENTS 5,621,420 A * 4/1997 Benson ..... 343/791
5,784,034 A * 7/1998 Konishi et al. ..... 343/895
5,963,178 A * 10/1999 Jones ..... 343/890
6,906,684 B2 * 6/2005 Turner ..... 343/900
6,940,469 B2 * 9/2005 Gottl et al. ..... 343/890

FOREIGN PATENT DOCUMENTS

| | | | |
|---|---|---|---|
| EP | 198 024 | A1 | 7/2001 |
| FR | 2 851 694 | A1 | 2/2003 |
| FR | 2 888 671 | A1 | 7/2005 |
| WO | WO 98/58420 | | 12/1998 |

OTHER PUBLICATIONS

PCT Written Opinion and citation listing from International Search Report for International Application No. PCT/IB 2006/003235 dated May 24, 2007.

* cited by examiner

*Primary Examiner* — Trinh Dinh

(57) ABSTRACT

The invention relates to a structure comprising an enclosed antenna system, and a radome (18), where the structure comprises: a tower (B, C), comprising a main tube (2) fastened on a bottom flange (7) of the tower (B, C), a smaller-diameter tube (5) which hooks within the main tube (2) and further is fastened on an upper flange (8) of the tower (B, C), a nut (6) fastened on the other end of said smaller-diameter tube (5), a rod (3) which screws on within the nut (6), a shaft (4) fastened at the bottom part of the rod (3) and terminating in a nut (1), where the radome (18) is fastened on the upper flange (8) of the tower (B,C), thus making it possible to check the antennas mounted on the main tube (2) by that when screwing the nut (1), the radome (18) is arranged to move upwards, making the bottom of the antenna system accessible.

17 Claims, 6 Drawing Sheets

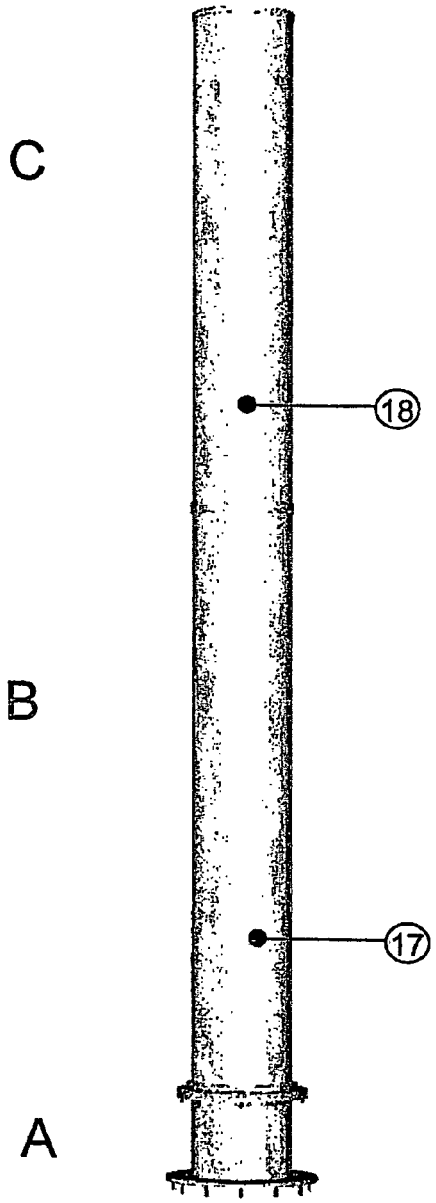
Fig 2A
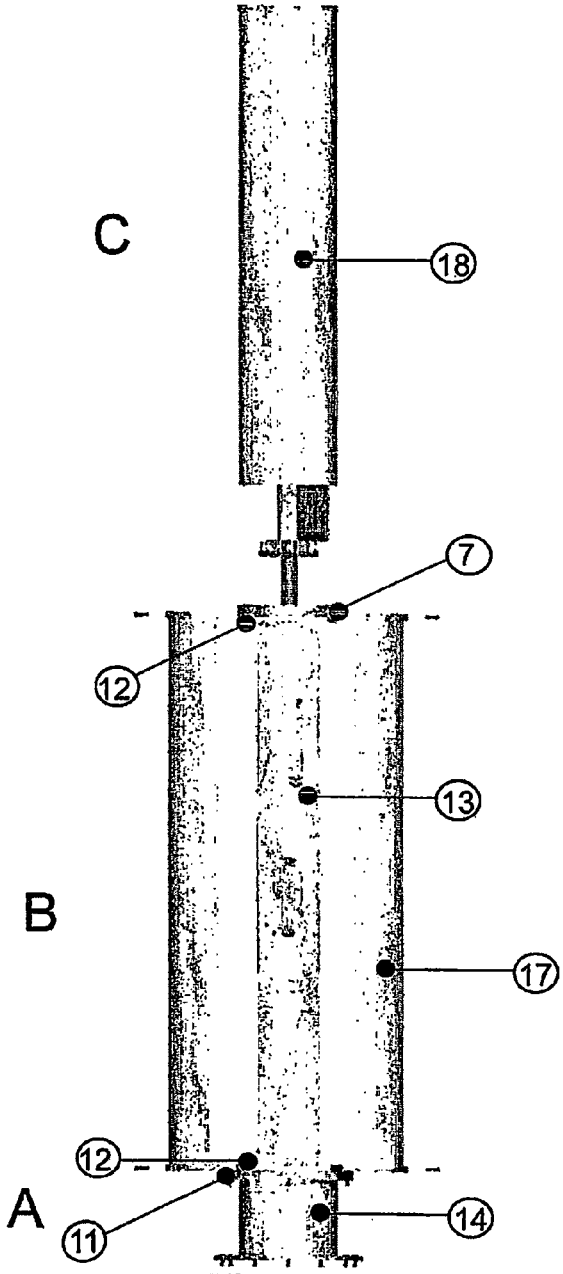
Fig 2B
Fig 2

SMART POLE

RELATED APPLICATIONS

This application is the U.S. National Phase under 35 U.S.C. §371 of PCT/IB2006/003235, filed on Nov. 16, 2006, which in turn claims the benefit of GREECE Application No. 20050100576, filed on Nov. 22, 2005, the disclosure of which Application is incorporated by reference herein.

BACKGROUND OF THE INVENTION

The present invention relates to mobile telephony systems.

SUMMARY OF THE INVENTION

In a first aspect, the present invention provides a structure comprising an enclosed antenna system, and a radome. The structure further comprises a tower having a main tube fastened on a bottom flange of the tower, a smaller-diameter tube which fits within the main tube and further is fastened on an upper flange of the tower, a nut fastened on the other end of the smaller-diameter tube, a rod which screws on within the nut, and a shaft fastened at the bottom part of the rod and terminating in a second nut. The radome is fastened on the upper flange of the tower, thus making it possible to check the antennas mounted on the main tube. When screwing the second nut, the radome is arranged to move upwards making the bottom of the antenna system accessible.

In another aspect, the present invention provides a structure comprising an enclosed antenna system, and a radome. The structure further comprises a tower having a main tube welded or screwed on a bottom flange of the tower, a smaller-diameter tube which hooks within the main tube and further is welded smaller-diameter tube, a rod which screws on within the nut, a shaft welded at the bottom part of the rod and terminating in a second nut. The radome is welded on the upper flange of the tower, thus making it possible to check the antennas mounted on the main tube. When screwing the second nut, the radome is arranged to move upwards making the bottom of the antenna system accessible.

In another aspect, the present invention provides a smart pole structure containing an antenna system and radiating and active systems including one or more antennas, filters, and amplifiers. The smart pole is cylindrically shaped, its inside is fabricated from a light load bearing material and the outside from a synthetic material, permeable by electromagnetic radiation and capable of protecting the internal parts against weather conditions. The pole further comprises a footing assembly, a body portion mounted on the footing assembly, and a top portion comprising a main tube having one or more antennas mounted therein. The pole further provides a means for opening the structure from the bottom of the top portion to expose the antennas which are mounted in the main tube.

Further aspects are described in the following detailed description of the invention.

BRIEF DESCRIPTION OF THE DRAWINGS

FIG. 2A is a side perspective view of the three sections (A, B, C) of the smart pole, and FIG. 2B is a side partial cutaway view showing an expanded portion of the middle section (B) of the smart pole in a preferred embodiment of the invention.

DETAILED DESCRIPTION OF THE INVENTION

Figure 1:
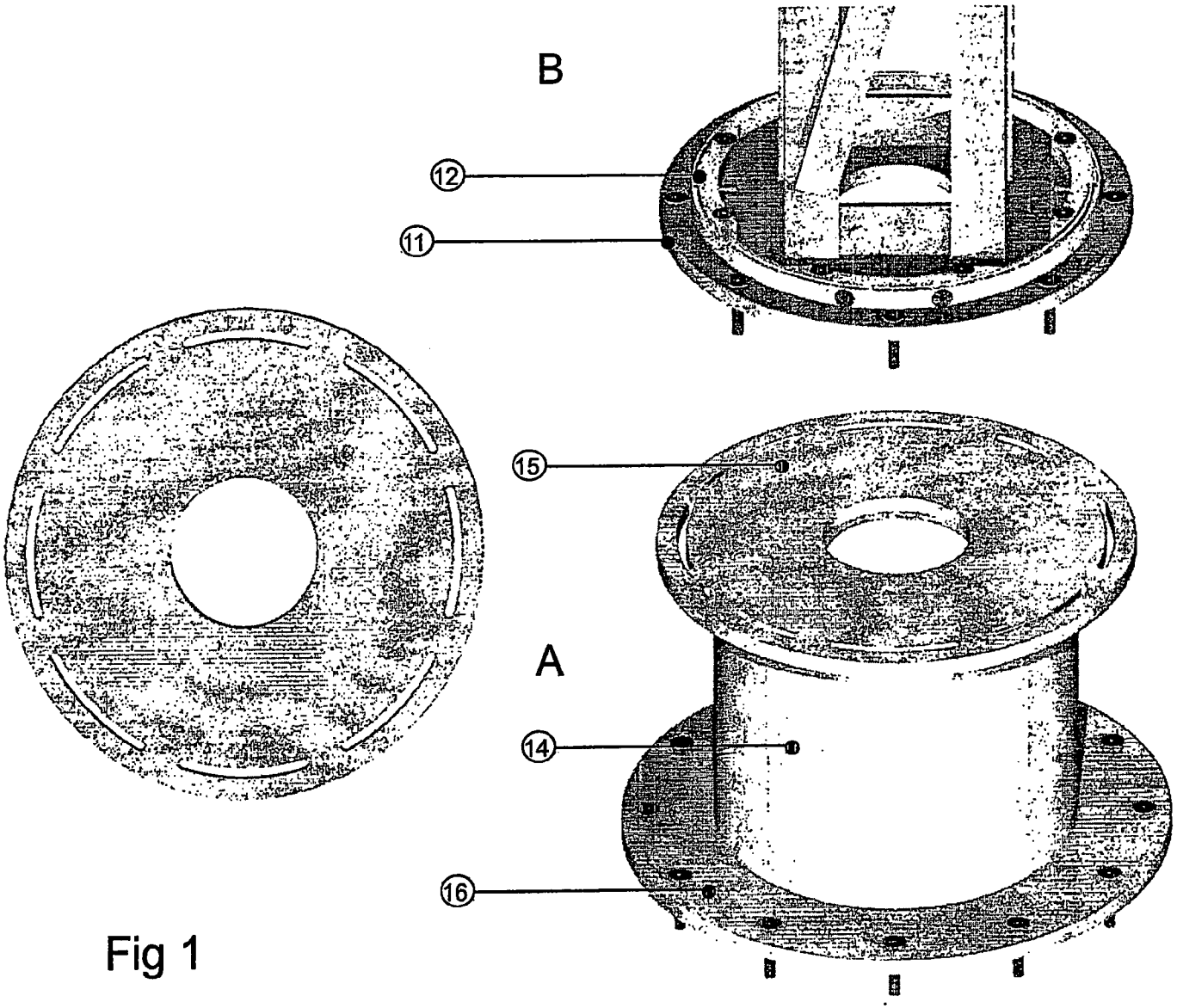
FIG. 1 is a top and perspective view of the bottom section (A) and a cutaway bottom portion of the middle section (B) of the smart pole in a preferred embodiment of the invention.

The invention relates to an antenna system, in the form of a cylindrical monopole pole, that shall include all radiating and active systems (antennas, low noise amplifiers, etc.) of a Mobile Telephony Station. The invention is cylindrically shaped, its inside fabricated from aluminum (bearing structure) and the outside (it is enclosed) from a synthetic material, fully permeable by electromagnetic radiation and fully capable of protecting the internal parts against weather conditions.

On the inside it shall contain all radiation systems of a Mobile Telephony Station, i.e. antennas, low noise amplifiers, filters, etc.

The objective of the invention is on one hand to solve problems and satisfy vital needs of Mobile Telephony networks and to play an instrumental role in the growth of the business of the company on a national and international level on the other. More specifically:

$1^{st}$ Problem:

Given that network planning by Mobile Telephony Companies involves specific design and equipment for each Station, this also implies that a structure that is each time different is implemented.

Each Base Station, depending on the antenna transmission frequency (900 MHz GSM—$1^{st}$ generation Mobile Telephony, 1800 DCS—$2^{nd}$ generation and 2100 MHz UMTS—$3^{rd}$ generation) and the technologies employed by the network for information transfer, requires the construction and installation of a plurality of equipment and accessories which are different in each specific case.

The new product solves this problem given that, rather than one antenna with its accessories, it is an antenna system, i.e. one monopole pole within which 1G-2G-2.5G and 3G technologies shall be integrated and supported at the same time.

The individual parts of the structure are connected in such a manner as to ensure that minimal equipment is required within the system and that the individual sections interact in a manner rendering the antenna system functional and efficient.

The benefit for end users—Mobile Telephony Operators—is obvious: cost savings in network equipment, meeting of all transmission frequency needs via a single antenna system, faster issuance of installation and operation permits as a result of standardized construction.

$2^{nd}$ Problem:

So far, the installation of Mobile Telephony Stations on buildings in urban areas requires major infrastructure in terms of the steel structure but also the auxiliary infrastructure, cable ladders, etc.

At the same time, the additional weight is often marginal in terms of the strength of old buildings, so that static interventions are required on the building roofs before antennas can be constructed and installed.

The new product solves this problem given that the required infrastructure is considerably lighter and less bulky.

The new antenna system, along with all its parts and accessories, is estimated to be 70% lighter and considerably less bulky compared with existing antennas; therefore, the time as well as the cost for erecting the necessary infrastructure for the installation of the system is significantly reduced, while at the same time transportation and installation work is drastically sped up, particularly so in the case of installation on roofs of buildings, given that no crane or special trucks are required for the transportation of the new antenna system.

3rd Problem:

Given that Mobile Telephony technology is evolving very rapidly, e.g. GSM 900 (1G), DCS 1800 (2G), i-mode (2.5G), UMTS (3G), Mobile Telephony Operators are compelled to often upgrade their Stations mainly within towns. In 2004 the launching of the provision of third generation (3G) services was accelerated through the licensing of three providers (COSMOTE—VODAFONE & TIM HELLAS) for the provision of commercial services over 3G/UMTS networks based on WCDMA (Wideband Code Division Multiple Access) technology.

Full commercial rollout and installation shall increase during years 2005 and 2006, at which time the extent of consolidation of third-generation services in the market could be assessed.

UMTS offers much faster access than anything we know so far and unifies packet- and circuit-switching technologies in data transmission.

This technology shall take communications into the Information Society of the 21st century, providing universal access to multimedia services, irrespective of location, network and terminal used.

A factor that makes UMTS superior to the second-generation systems is its ability to provide interactive multimedia services and other broad range services. Summarizing, the most important advantages of UMTS are given below:

1. UMTS shall allow the transmission of value added information, such as commerce and entertainment services, to the users of Mobile Phones and satellite networks.

2. UMTS shall bring about the final convergence among technologies.

3. Finally, UMTS shall transfer low cost, high capacity data at rates approaching 2 Mbit/sec.

The existing infrastructure of Mobile Telephony networks in UMTS technology is at an embryonic stage but it is estimated that, given the increased demand for 3rd generation services in the next 2 years, such infrastructure shall rapidly expand compelling Mobile Telephony operators to proceed with major upgrading and expansion of their existing networks.

This means that new installations, integrating all technologies available, shall be required in order to meet market needs.

The new product, by integrating all technologies (from 1st through 3rd generation) in one antenna system, shall enable Operators to upgrade and expand their networks at a considerably lower cost, speeding up at the same time the procedures for network transition to UMTS technology.

Moreover, Operators increasingly use common infrastructure and co-siting, i.e. joint use of a particular facility or premises.

Co-siting requires interventions of significant cost on the conventional infrastructure, problems which are solved by the new product given that, due to its functionality and originality, intervention times and cost shall considerably decrease.

4th Problem:

A major issue with Mobile Telephony Operators around the world is securing new sites within urban areas.

The number of their subscribers as well as services offered increases, resulting in the need to establish new Stations.

The difficulty lies in the fact that due to the size and the complexity of the structure, the proprietors of the premises are reluctant to agree on leasing arrangements.

The new product, that shall constitute the subject of the proposed research, shall differ considerably on the outside compared with the respective antenna systems currently on the market, with minimum and aesthetic visual impact and it shall be 70% smaller in volume and weight.

Legend of the numbers shown in the drawings: 1) Nut, 2) Main Tube, 3) Rod, 4) Shaft, 5) Internal Tube, 6) Nut, 7) Bottom Flange of the Tower, 8) Upper Flange of the Tower, 9) Shaft Nut, 10) Oval-shaped Holes, 11) Bottom Flange of the Frame, 12) GRP Fastening Semicircles, 13) Frame, 14) Supporting Base, 15) Flange, 16) Support Flange, 17) GRP in Semi-Cylindrical form, 18) GRP in Cylindrical form, 19) Electromotor, 20) Flanges, 21) Antennas, 22) Rod, 23) Screw nut, 24) Screw nut.

The smart pole consists of three main sections:

a) Footing Assembly (Base)

b) The Main Body (lattice)

c) The Top

1) The Footing Assembly is comprised of two flanges. The footing flange (16) on which there are 12 Φ14 holes concentrically and at a diameter of 700 mm.

The overall diameter of the flange (16) is 750 mm.

An (aluminum) tube 0500 mm (14), 270 mm long, is welded or screwed on the flange (16).

An aluminum flange (15), of a diameter of 650 mm, is welded on the tube, as shown in FIG. 1.

The flange concentrically has slots at a diameter of 580 mm.

The base is designed in such a manner as to enable the use of a drill for the footing of the base (e.g. on cement).

2) The Body consists of the bottom flange (11) of a diameter of 650 mm, on which there are two concentric rows of 012 holes:

The first row, at a diameter of 580 mm, such as to correspond to flange (15), and the second row of holes at a diameter of 450 mm on which two aluminum semicircles (12) are screwed on for fastening the two GRP semicircular plastic parts. (FIG. 2).

A lattice (13) is welded or screwed on the flange (11), perpendicularly to it.

At the upper part of the lattice a flange (7) is welded or screwed on, of a diameter of 500 mm, having concentric holes Φ10 at a diameter of 450 mm so that two aluminum semicircles (12) can be screwed on at its bottom for fastening the two semicircular plastic GRP. (FIG. 2)

Figure 3:
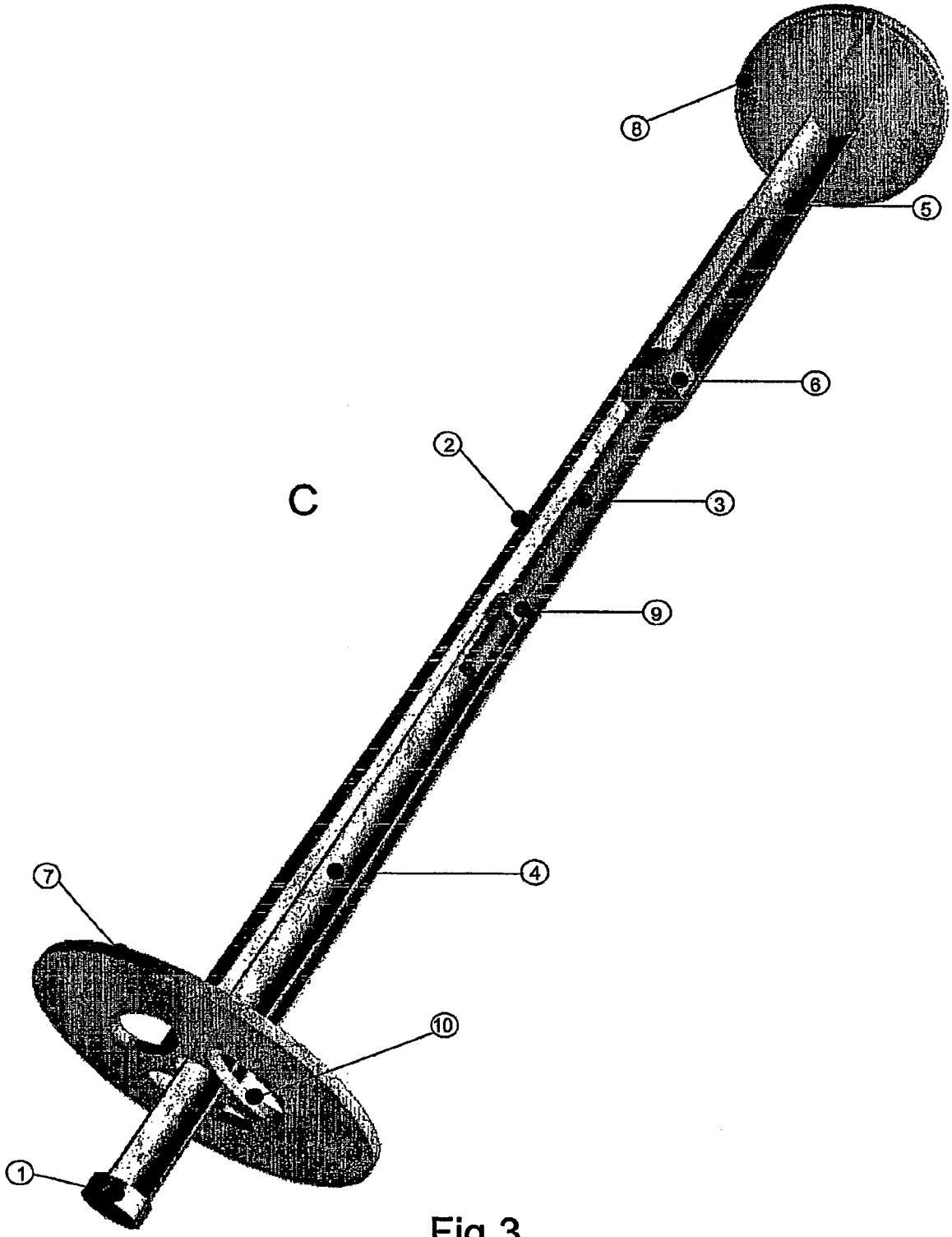
FIG. 3 is a perspective view of the top section (C) of the smart pole in a preferred embodiment of the invention.

Moreover, there are three oval-shaped holes (10), having a diameter of 160 mm×80 mm, for passing the suitable cabling from the top (r) to the lattice (B). (FIG. 3)

Figure 4:
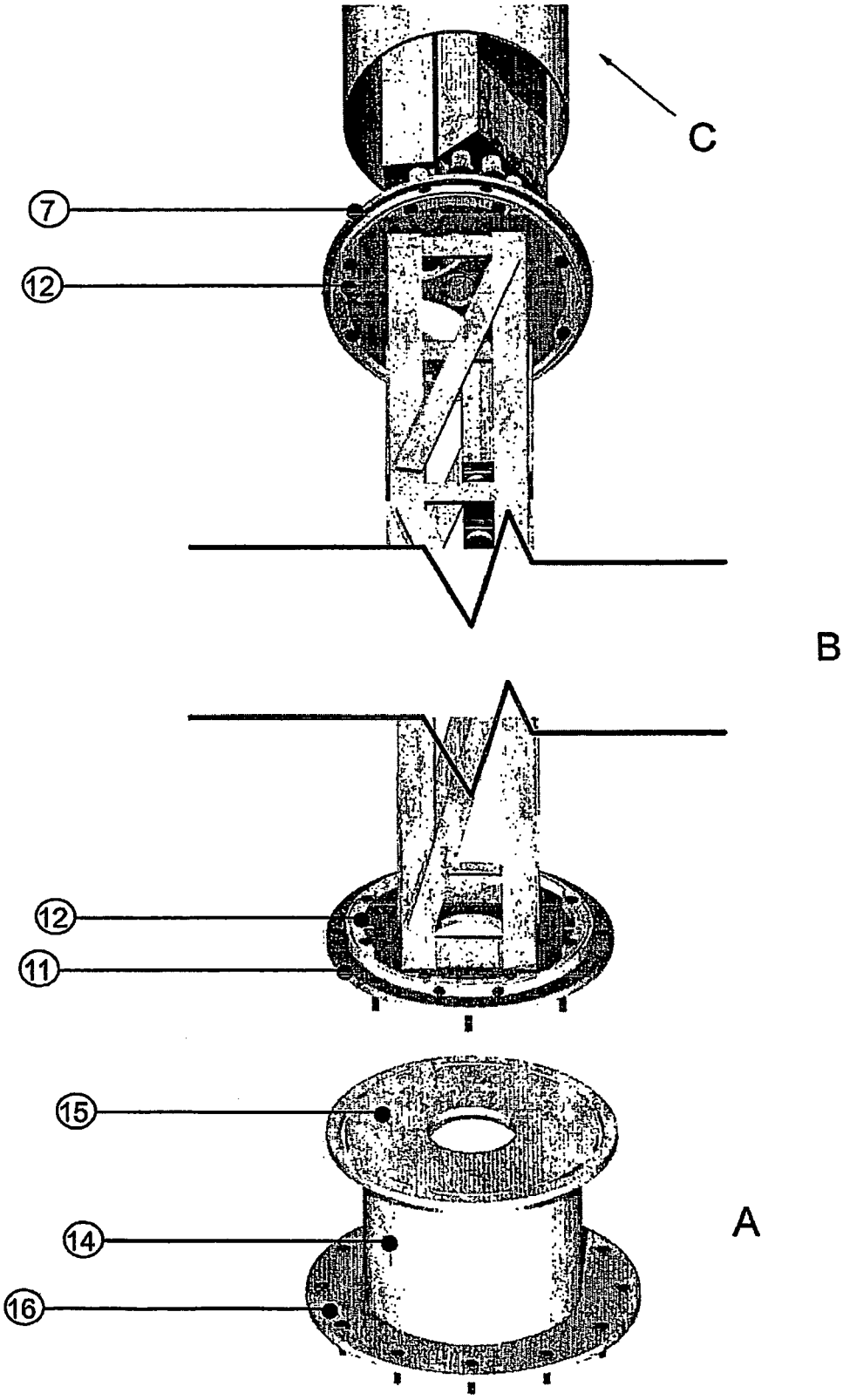
FIG. 4 is a cutaway sectional view of the smart pole showing portions of the three main sections (A, B, C) in a preferred embodiment of the invention.

The GRP plastic semicircles are fastened on the structure as shown in FIG. 4), that is, the GRP (17) is adjacent to the semicircles (12) and is then screwed on at three locations of each semicircle.

3) The Top consists of the main tube (2) having a diameter of 60 mm, which is welded or screwed on the flange (7), the upper flange (8) of a diameter of 500 mm on which a smaller-diameter (50 mm) tube (5) is welded or screwed on, which hooks within the main tube (2).

At the other end of the tube (5) a special nut (6) is welded within which the rod (3) screws on.

On the rod (3) and at the bottom part of the rod (3) there is a welded shaft (4) for rod extension purposes, terminating in an hexagonal nut (1).

Via this mechanism it is possible to visit the structure from the bottom of its Top for checking and tuning the antennas which are mounted in the main tube (2).

This is achieved when, by screwing the nut (1) the radome (GRP) (18) which is welded on the upper flange moves 40 cm upwards and thus the bottom of the antenna system is accessible. (FIG. 2*b*).

By unscrewing the nut (1) the radome along with the upper flange (8) resumes its original position. (FIG. 2*a*).

Figure 5:
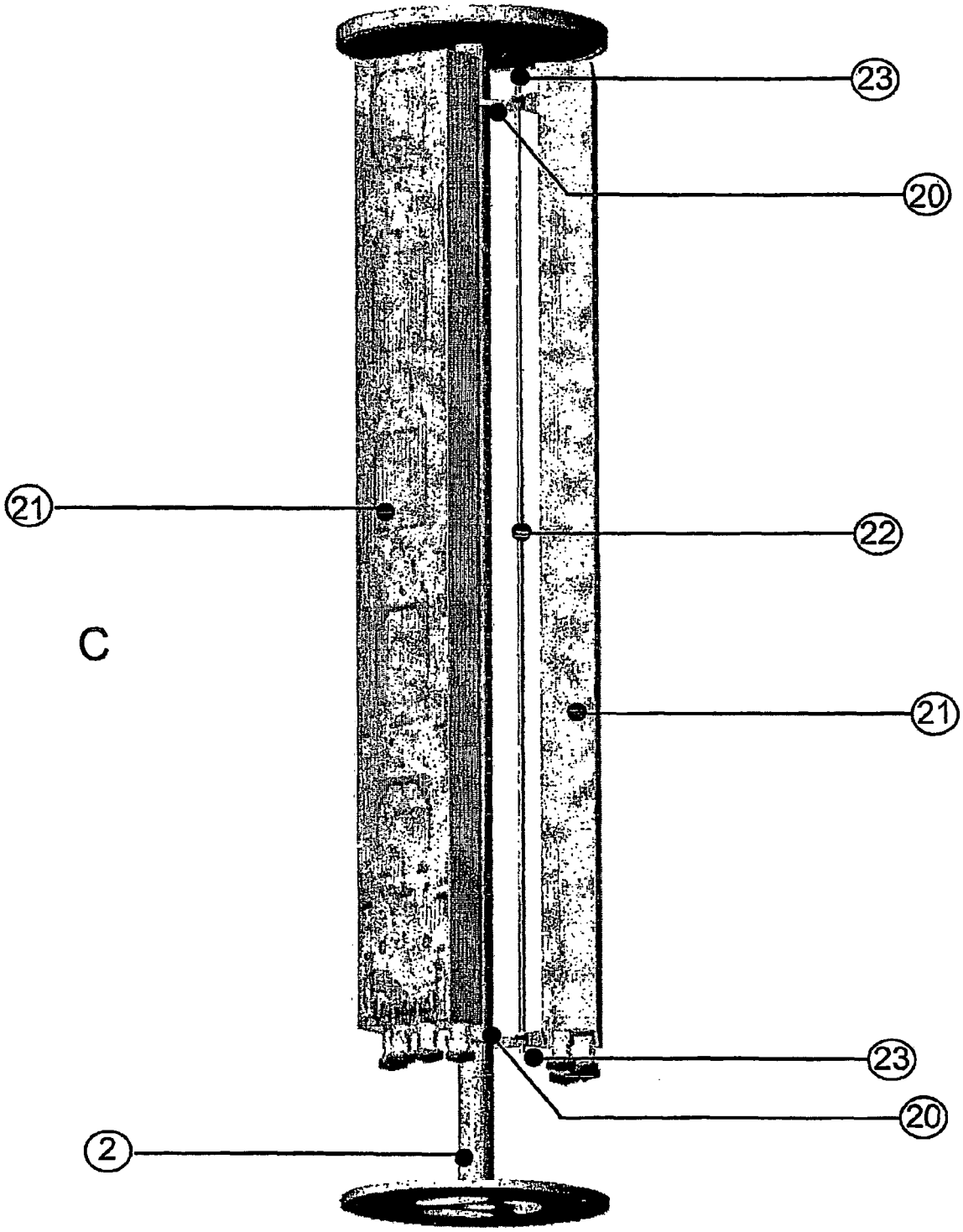
FIG. 5 and FIG. 6 are side perspective views of the top section (C) of the smart pole in a preferred embodiment of the invention.

Two flanges (20) having a diameter of 170 mm. are welded or screwed on the main tube (2). (FIG. 5).

The antennas (21) are mounted on these flanges with the aid of the rod (22). M=8 mm By unscrewing the nut (23) M=8 mm we are able to rotate our antenna to the left or to the right in the desired direction and then tighten the nut (23) in order to stabilize our antenna in the desired direction. The respective nut (24) M=8 mm at the top of the rod is welded on it so that the rod (22) along with the nut (24) functions as a screw. Between the nut (24) and the antenna support there is a spring washer, M=8 mm, so that the rod (22) can be tightened just from the nut (23).

The rod, in the part between the two flanges (20), may be a shaft (i.e. not threaded).

Figure 6:
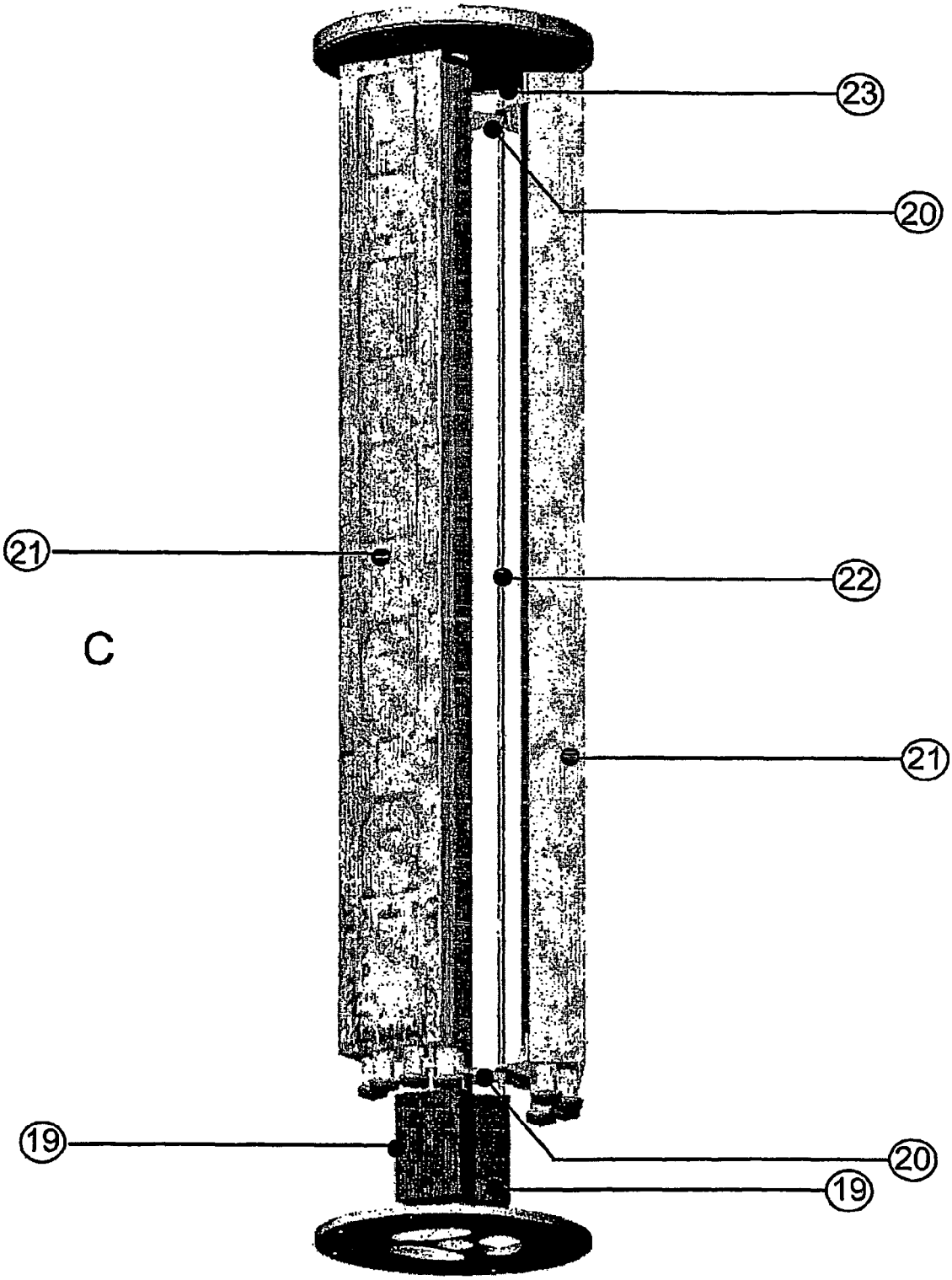

The moving of the antennas may be made either manually (as above described) or by using a motor (19) which is mounted on the main tube (2) and rotates the rod (22) [FIG. 6] and the antenna (21) which is welded or screwed on the rod (22).

Moreover, the Top (r) and the Body (B) which are screwed together can rotate on the base (A) in horizontal rotation for a better orientation of the antennas.

The whole metal structure is made of aluminum and it contains all radiation elements (antennas–filters–low noise amplifiers, etc.).

With the smart pole, transportation and installation is very easy given that this is a split (modular) and light structure, and the time for its assembly and installation is very short thanks to the layout and design of the complete structure.

The invention claimed is:

1. Structure comprising an enclosed antenna system, and a radome, wherein the structure comprises:

a tower, comprising a main tube fastened on a bottom flange of the tower, a smaller-diameter tube which fits within the main tube and further is fastened at one end on an upper flange of the tower, a nut fastened on the other end of said smaller-diameter tube, a rod which screws on within the nut, a shaft fastened at the bottom part of the rod and terminating in a second nut, wherein the radome is fastened on the upper flange of the tower, thus making it possible to check the antennas mounted on the main tube by screwing the second nut, wherein the radome is arranged to move upwards making the bottom of the antenna system accessible.

2. Structure according to claim 1, wherein the structure further comprises filters and/or low noise amplifiers.

3. Structure as claimed in claim 1, wherein the structure comprises all radiating and active systems of a mobile telephony station.

4. Structure as claimed in claim 1, wherein the tower comprises a body and a top.

5. Structure according to claim 4, wherein the body comprises a bottom flange, a lattice welded or screwed on the bottom flange, and further the bottom flange of the tower which is welded or screwed on the upper part of the lattice.

6. Structure according to claim 5, wherein the bottom flange of the tower comprises holes for passing cabling from the top.

7. Structure according to claim 4, wherein the top comprises the main tube welded or screwed on the bottom flange of the tower, the smaller-diameter tube which hooks within the main tube and which further is welded or screwed on the upper flange of the tower, and the upper flange of the tower.

8. Structure as claimed in claim 1, wherein an antenna is arranged to be able to be rotated relative to the main tube, either manually by unscrewing and screwing a nut or by using a motor which rotates the antenna.

9. Structure as claimed in claim 1, further comprising a base.

10. Structure according to claim 9, wherein the tower, comprising a top welded or screwed to a body, is arranged to be able to be rotated on the base for better orientation of antennas.

11. Structure as claimed in claim 1, wherein the bearing part of the structure is made of aluminum.

12. Structure as claimed in claim 1, wherein active systems reside in the interior of the body.

13. Structure as claimed in claim 1, wherein the casing of the body is split in two sections for easy access to its interior.

14. Structure as claimed in claim 1, the structure further comprising an enclosing part enclosing active internal parts, wherein the enclosing part of the structure is made from a synthetic material fully permeable by electromagnetic radiation and fully capable of protecting the internal parts against weather conditions.

15. Structure as claimed in claim 1, wherein the radome is made from a synthetic material fully permeable by electromagnetic radiation and fully capable of protecting the internal parts against weather conditions.

16. Structure as claimed in claim 1, wherein the radome is arranged to move upwards making the bottom of the antenna system accessible by that the main tube is arranged axially movable and rotatably fixed relative to the smaller-diameter tube.

17. Structure comprising an enclosed antenna system, and a radome, wherein the structure comprises:

a tower, comprising a main tube welded or screwed on a bottom flange of the tower, a smaller-diameter tube which hooks within the main tube and further is fastened at one end on an upper flange of the tower, a nut fastened on the other end of said smaller-diameter tube, a rod which screws on within the nut, a shaft welded at the bottom part of the rod and terminating in a second nut, wherein the radome is welded on the upper flange of the tower, thus making it possible to check the antennas mounted on the main tube by screwing the second nut, wherein the radome is arranged to move upwards making the bottom of the antenna system accessible.

* * * * *